US008360818B2

(12) United States Patent
Crocco et al.

(10) Patent No.: US 8,360,818 B2
(45) Date of Patent: Jan. 29, 2013

(54) AUTOMATED CHEMICAL POLISHING SYSTEM ADAPTED FOR SOFT SEMICONDUCTOR MATERIALS

(75) Inventors: Jerome Crocco, Chicago, IL (US); Rasdip Singh, Palos Hills, IL (US)

(73) Assignee: EPIR Technologies, Inc., Bolingbrook, IL (US)

( * ) Notice: Subject to any disclaimer, the term of this patent is extended or adjusted under 35 U.S.C. 154(b) by 0 days.

(21) Appl. No.: 12/690,177

(22) Filed: Jan. 20, 2010

(65) Prior Publication Data

US 2010/0120334 A1 May 13, 2010

Related U.S. Application Data

(62) Division of application No. 11/832,759, filed on Aug. 2, 2007, now Pat. No. 7,824,245.

(51) Int. Cl.
*B24B 7/22* (2006.01)

(52) U.S. Cl. ..... 451/8; 451/288; 451/5

(58) Field of Classification Search ..... 451/288, 451/287, 5, 8, 10, 11, 28, 63, 41
See application file for complete search history.

(56) References Cited

U.S. PATENT DOCUMENTS

| | | | |
|---|---|---|---|
| 4,256,535 | A | 3/1981 | Banks |
| 4,373,991 | A | 2/1983 | Banks |
| 5,595,522 | A | 1/1997 | Simpson et al. |
| 5,882,539 | A | 3/1999 | Hasegawa et al. |
| 6,387,809 | B2 | 5/2002 | Toyama |
| 6,709,981 | B2 | 3/2004 | Grabbe et al. |
| 6,725,120 | B2 | 4/2004 | Saldana |
| 6,872,662 | B1 | 3/2005 | Hocheng et al. |
| 7,005,383 | B2 | 2/2006 | Lee |

*Primary Examiner* — Robert Rose
(74) *Attorney, Agent, or Firm* — Jefferson Perkins; Momkus McCluskey, LLC

(57) ABSTRACT

At least one wafer is suspended on a respective jig shaft above a polishing platen. The degree of parallelism between the wafer and the polishing platen is controlled using a three-point suspension, which allows for planar pitch adjustments using vertical actuation algorithms. As the wafer is lowered into contact against the polishing platen, a load cell senses how much of the weight of the jig shaft, wafer mount and wafer continues to be supported by the jig. The vertical displacement of the wafer is controlled using a linear actuator responsive to a signal from the load cell. Vertical actuation of the wafer serves to increase or decrease this amount of supported weight, in turn decreasing or increasing the amount of applied down-force exerted between the wafer and the platen. A compression spring is used to increase the resolution of the pressure control. Finally, system components exposed to the work environment are encapsulated by chemically resistive components to prevent corrosion of system components.

8 Claims, 8 Drawing Sheets

AUTOMATED CHEMICAL POLISHING SYSTEM ADAPTED FOR SOFT SEMICONDUCTOR MATERIALS

RELATED APPLICATIONS

This application is a division of pending U.S. application Ser. No. 11/832,759, filed Aug. 2, 2007, the specification and drawings of which are fully incorporated by reference herein.

BACKGROUND OF THE INVENTION

Chemical polishing (CP) methods and apparatus have been known for many years. Prior art CP apparatus are directed to polishing the surfaces of relatively tough semiconductor materials such as those composed of elemental silicon. On such common semiconductor (and insulator) materials, one can exert appreciable pressure on the face to be polished without causing failure of the workpiece.

Some semiconductor materials, particularly Group II-VI semiconductor materials and more particularly mercury cadmium telluride (MCT) and cadmium telluride (CT) materials, are more fragile and cannot withstand excessive downward pressure of the sort exerted in conventional polishing processes. By way of illustration, as measured on the Vickers scale, elemental silicon has a hardness of 1100 kg/mm$^2$, GaSb a hardness of 450 kg/mm$^2$, InSb a hardness of 438 kg/mm$^2$, and $Hg_{0.8}Cd_{0.2}Te$ a hardness of only 35 kg/mm$^2$. Therefore, particularly for Group II-VI semiconductor materials, very low pressures must be used. To date, conventional CP apparatus have been less than satisfactory in using only light pressures yet exerting sufficient control.

Several conventional semiconductor polishing systems do not provide for the use of chemical polishing solutions. Exposed steel components and open air polishing systems prohibit the use of chemical etchants such as bromine and hydrochloric acid. The use of these chemicals is critical, however, for controlling the stoichiometry of the polished crystalline surface.

SUMMARY OF THE INVENTION

The present invention is directed to resolving these problems of precision and control throughout the duration of the polishing operation, using components able to withstand harsh environmental conditions. According to one aspect of the invention, a polishing platen, which preferably rotates about its axis, is supported by a base. At least one workpiece (such as a wafer) is suspended above this platen by a mount on a jig shaft, which in turn is supported by a jig. Preferably, each component exposed to this work area is encapsulated in a chemically resistant material, such as polytetrafluoroethylene or polypropylene. As the workpiece is lowered onto the platen, a sensor, such as a load cell, senses that amount of a first weight, which includes the weight of the jig shaft, mount and workpiece, which continues to be supported by the jig. As the amount of the first weight supported by the jig decreases, the amount of the first weight which is supported by the platen increases, and therefore the pressure between the workpiece and the platen increases. Means such as a programmed controller may receive a signal from the load cell and control the up-and-down displacement of the jig shaft as a function of this signal. This feedback loop can regulate the amount of pressure between the platen and the workpiece.

It is preferred that the jig shaft be supported by the jig by means of a spring, and even more preferably by means of a helical compression spring. This spring allows a smooth variation in the amount of supported weight and more precise control, over a lengthened vertical displacement of the jig shaft.

In a related aspect of the invention, an array of stored values, representative of a weight function which varies over time in a way desired by the operator of the machine, may be used to supply the stored value against which the supported amount of the first weight as defined above is compared. Alternatively the amount of the first weight which is bearing down on the platen may be calculated and compared with a selected one of the stored value array. Further, control circuitry and software according to the invention may be provided which do not energize the linear actuator until a dead-band around the stored value has been departed from by the measured value or its derivative.

According to another aspect of the invention, the jig is supported by a jig deck. The jig deck in turn is supported by at least three upstanding spaced-apart shafts that in turn are connected to spaced-apart support points on the jig deck. The support points can be moved by means of the shafts upwardly or downwardly in order to raise or lower the jig deck and to alter the angle of the plane of the jig deck. Circuitry is provided to ensure that the plane occupied by the jig deck is parallel, within a predetermined tolerance, to the plane of the upper surface of a platen.

Preferably, portions of these shafts are threaded, and those portions are threadably received by the jig deck support points. Stepper motors can be provided to turn the shafts in predetermined increments to raise or lower the support points.

According to yet another aspect of the invention, the workpiece may be polished by a combination of up to four controlled movements: the rotation of the platen about its axis, the rotation of the jig shaft about its axis, a translational and reciprocal movement of the jig relative to the platen and in a direction orthogonal to the platen axis (and parallel to an upper surface of the platen), and finally a translational and reciprocal movement of the workpiece in a direction parallel to the axis of the platen. Preferably, a plurality of such jigs may be so translated by independent motors, providing uniform motion of a respective plurality of workpieces. Each of the motors driving the platen shaft, the jig shaft and the jig may be separately controlled according to respective sensors and feedback circuitry, as desired.

The present invention thus provides polishing apparatus in which the motions of the platen and workpiece, and the pressure between them, are precisely controlled. The periodic measurement of the supported weight (and the comparison of that weight (or a calculated derivative of it) against a stored reference) allows continuous adjustment of downward pressure as the polishing operation progresses. The use of a spring to more smoothly vary the amount of downward pressure relative to vertical displacement of the jig shaft permits enhanced precision.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
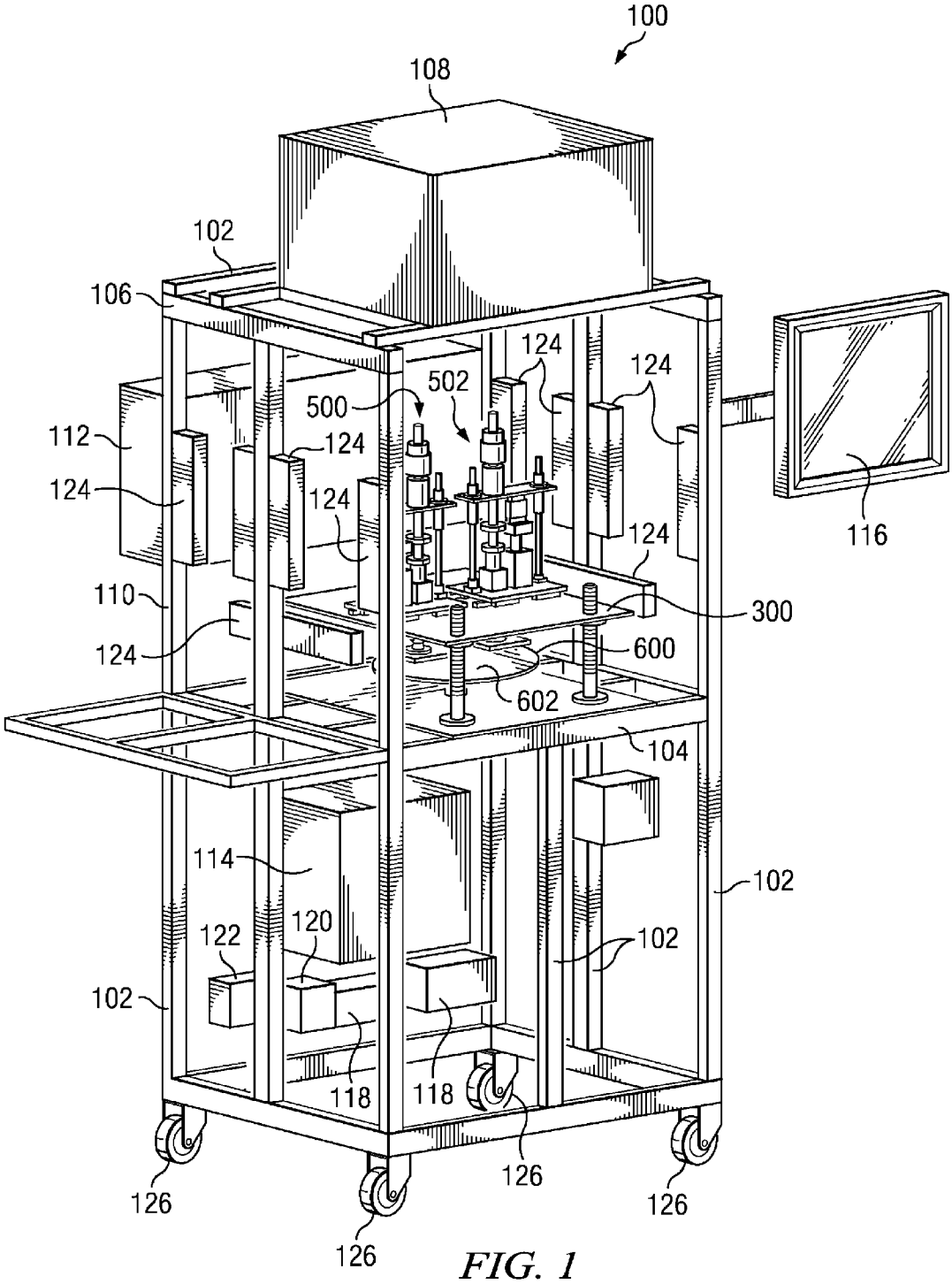
FIG. 1 is an isometric view of a chemical polishing (CP) machine according to the invention, with certain parts omitted for the purpose of clarity.

A polishing machine according to the invention, as installed in a supporting structural framework 100, is shown in FIG. 1. The frame 100 may be conveniently assembled from metal members 102 which may be made of steel, aluminum or similarly strong structural material. The frame 100 provides the structural support for the various machine components, such as the jig deck 300, polishing jigs 500, 502 and the polishing platen 600. The frame 100 includes a horizontal jig deck support grid 104 that, in the illustrated embodiment, is positioned approximately in the center of the frame 100. The jig deck support grid 104 provides structural support for the jig deck 300 (via a base and support shafts, later described) and indirectly the jigs 500, 502 and the polishing platen 600, and related equipment.

The main polishing machine components 300, 500, 502 and 600 are housed in a space extending from the support grid 104 up to a ceiling 106 formed of further structural members 102. Since the illustrated polishing machine is a chemical mechanical polishing (CP) machine that uses hazardous chemicals, and can be employed to polish workpieces formed of heavy metals such as mercury, cadmium and tellurium, the ceiling 106 also serves to support a HEPA filter 108 through which air is permitted into the sealed enclosure (not shown) surrounding the main components. One vertical wall 110 of the frame 100 provides the support for a fume exhaust hood 112 from which noxious fumes are evacuated from the chamber. This hood 112 is made necessary by the use of specially formulated slurries with high vapor pressures used in the chemical polishing (CP) operation. The components housed within the polishing system are preferably encapsulated by a chemically resistant material such as polytetrafluorethylene or polypropylene, to prevent corrosion of critical system components through surface reactions with the noxious fumes evacuated by hood 112.

Conveniently, the frame can be made to house or support other equipment useful in the CP process. This other equipment includes an enclosure 114 for the motor controllers and stepper motor drivers, a monitor 116, and various other electronic components, such as power supplies 118, a linear actuator controller 120, a counter/frequency module 122 and light fixtures 124. The frame may be conveniently equipped with casters 126 so that it can be easily moved from place to place.

In the drawings, certain structural components of the illustrated CP machine have been omitted for the purpose of clarity. These include preferably transparent, preferably polymeric enclosure panels mounted on the frame 100, and the apparatus for delivery of slurry onto the top surface 602 of the polishing platen 600. This last apparatus includes suitable hoses, fluid reservoirs and metering devices. Also, many of the structures herein described are protected by various protective polymer sheets and bellows, such as ones made of polypropylene, polytetrafluoroethylene, neoprene, latex and the like, so as to reduce the opportunity for chemical attack by the slurry. It should be noted that while the invention is being described with reference to a CP machine for Group II-VI semiconductors, it has the flexibility for polishing all soft semiconductor materials with great precision.

Figure 2:
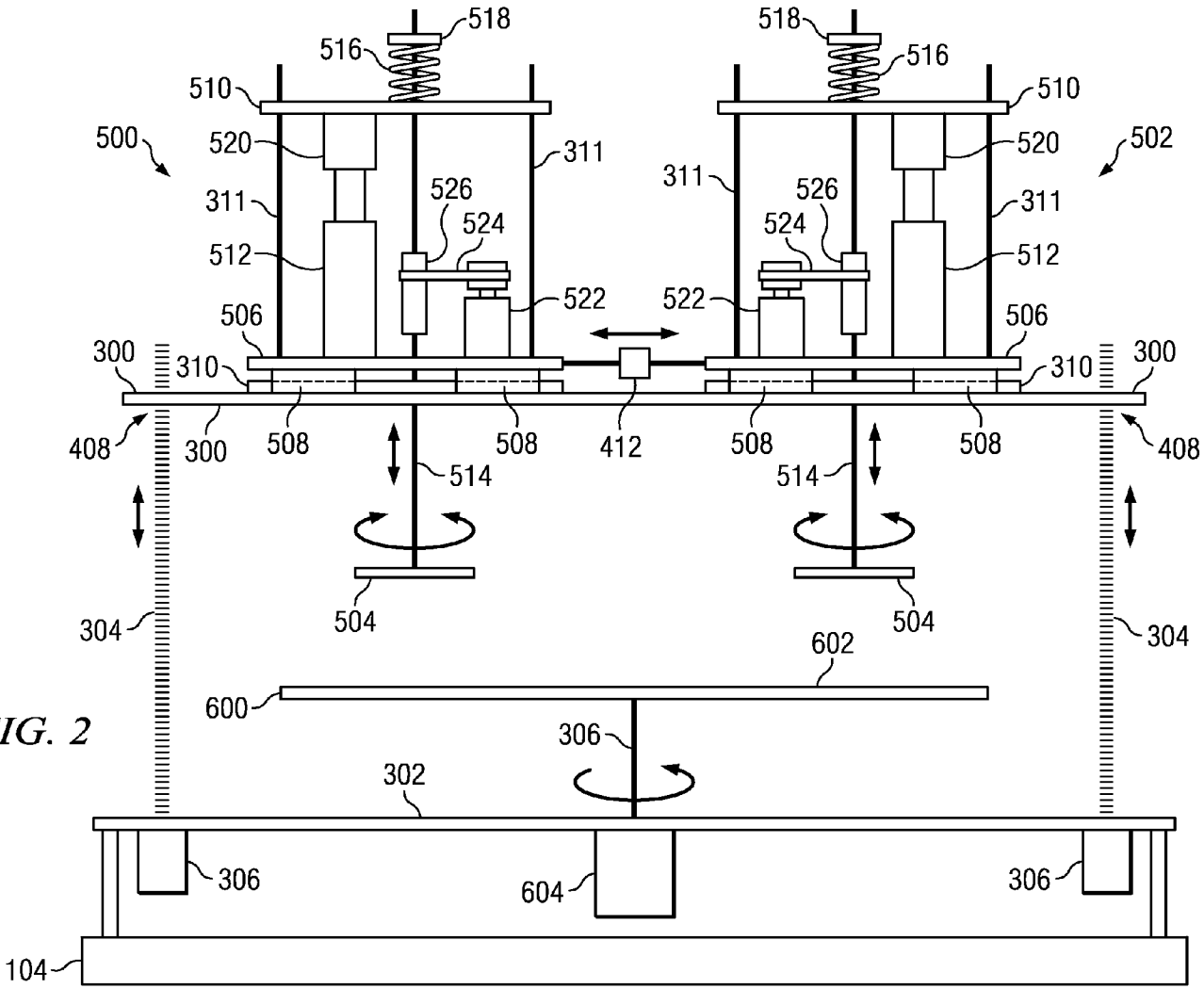
FIG. 2 is a schematic diagram of the structural components of a CP machine according to the invention, showing structural relationships and relative motions.

The overall arrangement and relative motions of the major structural components of the polishing machine are schematically shown in FIG. 2. The jig deck support 104 structurally supports a base plate 302. Support points 408 of the jig deck 300 are supported on three helical lead screws 304 (two shown in this FIGURE) which extend upwardly from respective stepper motors 306, which in turn are mounted on the base plate 302. The lead screws 304 and stepper motors 306 provide a means to insure that the plane of the jig deck 300 is exactly parallel to the plane in which the polishing platen 600 resides. This in turn insures the planar parallelism of the polishing platen surface 602 to the wafer mounts 504 of polishing jigs 500, 502.

The base plate 302 also has mounted to it a DC motor 604, which rotates a platen shaft 606 around its axis under control of a controller. This in turn spins the polishing platen 600. In the illustrated embodiment, the workpiece is mounted to the jig mounting chuck 504, with the work-face pointing down towards the polishing platen surface 602. Polishing platen surface 602 receives a polishing slurry, as by means of one or more flexible plastic feed tubes (not shown).

The jig deck 300 serves as the structural support for one, two or more polishing jigs; for purposes of illustration two such polishing jigs 500, 502 are shown. The jig deck 300 may be built of stainless steel and, for a CP embodiment, may have a polymeric cover (not shown) as protection against caustic slurry chemicals. Preferably, each jig 500, 502 is supported on a pair of parallel guide rails 310 that permit translational movement of each jig 500, 502 in a direction orthogonal to the axis of platen shaft 606 and parallel to the plane of upper platen surface (or polishing pad) 602. As will be later described, a single rack-and-pinion linear motor 412 can be controlled by a controller (not shown in this FIGURE) to move both of the jigs 500, 502 back and forth on the rails 310 in a reciprocal motion, such that the workpieces being polished will be done so uniformly.

Each jig 500, 502 has a horizontally disposed jig plate 506, underneath which are mounted guide blocks 508. The guide blocks 508 ride on the rails 310 of the jig deck 300. Each jig plate 506 is the structural base for supporting the remainder of the respective jig 500 or 502. A pair of linear alignment shafts 311 extend from the jig plate 506 through a pressure distribution plate 510. Using these dual alignment shafts, the pressure distribution plate 510 can be vertically actuated along both linear alignment shafts 311 without applying torque to the load cell 520 (discussed below). The pressure distribution plate 510 is supported by a linear actuator 512 that is disposed between the jig plate 506 and the pressure distribution plate 510. The linear actuator 512 is used to raise or lower the pressure distribution plate 510 relative to the jig plate 506 in incremental steps.

Each jig 500, 502 has a wafer mount 504 to which the workpiece or wafer to be polished is affixed. The wafer mount terminates a lower end of a shaft 514. The wafer, wafer mount 504 and shaft 514 are supported by the pressure distribution plate 510 via a spring 516, which preferably is a helical compression spring and is compressed between a top surface of the pressure distribution plate 510 (acting here as a stop for the lower spring end) and a clamp 518 affixed to the top portion of shaft 514, which acts as a stop for the upper spring end. Other types of springs can be used, so long as they are moveable (and preferably continuously so) between a stressed condition and a relaxed condition responsive to the vertical extension or contraction of the linear actuator 512. The shaft 514 rotates freely along appropriate thrust bearings relative to spring 516, pressure distribution plate 510 and jig plate 506, an aperture through the last of which the shaft 514 downwardly extends. A load cell 520, also disposed between the jig plate 506 and the pressure distribution plate 510, senses how much of the weight of shaft 514, wafer mount 504, the wafer itself and other components mounted on shaft 514 is being supported by the pressure distribution plate 510. In the illustrated embodiment the load cell 520 is positioned in a columnar stack with the linear actuator 512, but alternative physical dispositions of the load cell 520 could be made.

As the wafer mount 504 (and the workpiece affixed to it) are lowered toward polishing platen surface 602, the wafer will contact the platen 602, and the platen 602 will begin to support some fraction of the weight of shaft 514 and the items attached to it (sometimes referred to herein as the "first weight"). This fraction won't be all of the first weight, however, because the spring constant of the spring 516 allows the downward force on linear actuator 512 to be transferred to the polishing platen 602 over a distance which is directly proportional to the compression of the spring 516, as described by Hook's Law. A signal from the load cell can be used to actuate the linear actuator 512 to vary how much of the first weight is being relieved by the pressure distribution plate 510. As the pressure distribution plate is displaced upwardly, it will bear more of the weight experienced by shaft 514, while the platen surface 602 will bear less weight. As the linear actuator 512 is lowered, more of the first weight will be transferred from the pressure distribution plate to the platen surface 602, and as the linear actuator 512 is raised (or its length extended), less of the first weight will be borne by the platen surface 602. This provides a method to precisely measure how much downforce, and therefore how much pressure, is being experienced between the workpiece surface and the upper surface 602 of the platen 600.

For each jig 500, 502, a DC motor 522 is used to drive a timing belt 524 around a linear/rotational bearing 526 which is coaxial to, but spins freely relative to, the central shaft 514. A coaxial shaft clamp 610 (see FIGS. 5 and 6) is mounted directly to the shaft 514 above the linear/rotational bearing 526. The shaft clamp 610 itself has a periodic distribution of four linear bearings (not shown) at a radius R from the central shaft 514, parallel to the central shaft 514. The linear/rotational bearing 526 itself also has a distribution of four shafts 609 at a radius R from the central shaft 514, also parallel to this last shaft. Using the DC motor 522, the linear/rotational bearing 526 freely rotates clockwise or counterclockwise, depending on the applied voltage. When properly positioned, the four shafts 609 (FIG. 5) mounted to the linear/rotational bearing 526 engage with the four linear bearings in the shaft clamp 610. When engaged, the DC motor 522 torques the linear rotational bearing 526, which in turn engages the coaxial shaft clamp 610, which rotates the central shaft 514.

Figure 3:
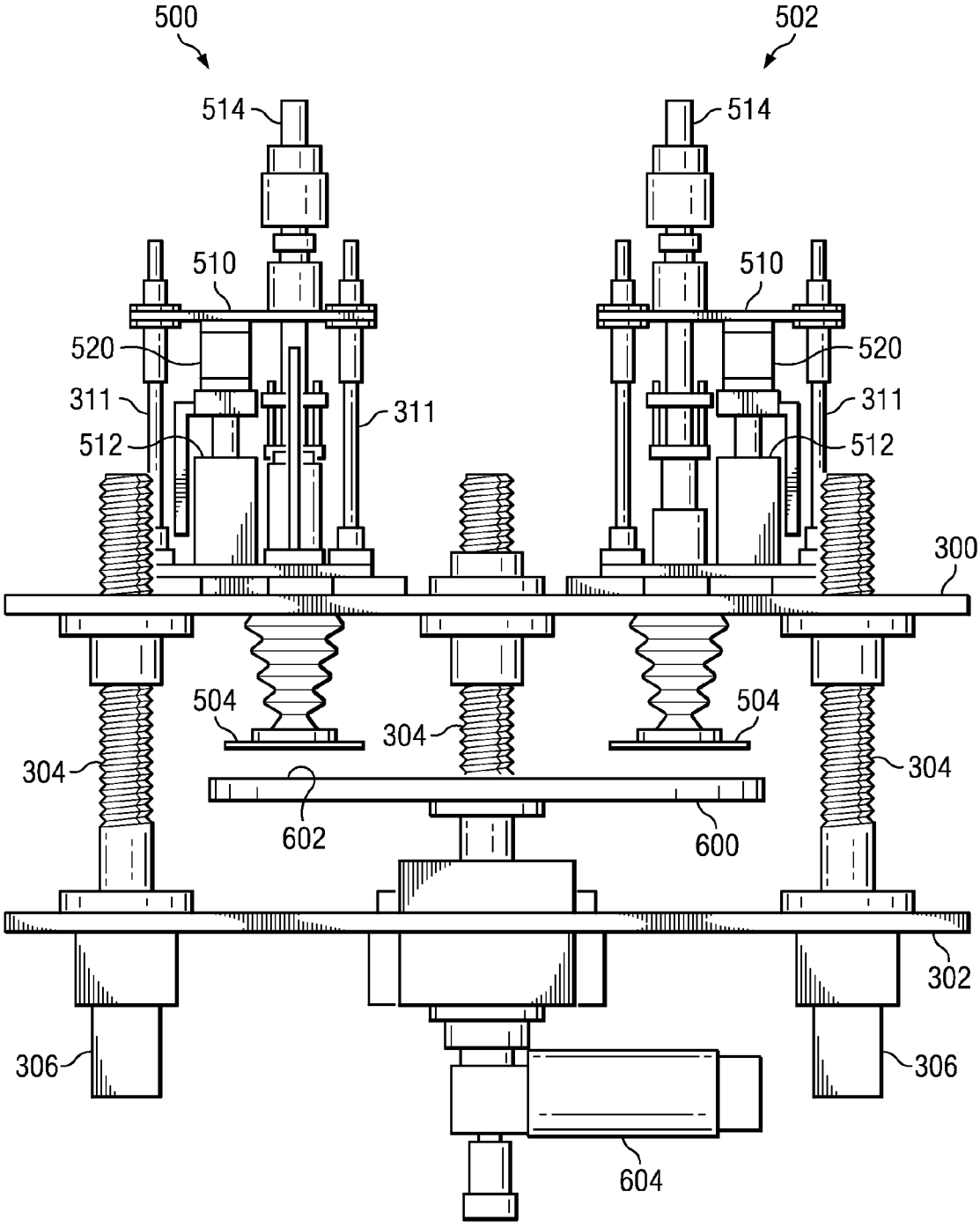
FIG. 3 is a front view of the jigs, jig deck, polishing platen and base plate of the CP machine diagrammed in FIG. 2.

FIG. 3 is an elevational view of the base plate 302, the jig deck 300 and the equipment mounted to these. It can be seen that in general the lead screws 304 support the jig deck 300 above the base plate 302 and the platen 600. The jig deck 300 in turn supports the jigs 500, 502. The shafts 514 of each jig 500 and 502 extend downward through respective apertures in the jig deck 300 to terminate in a respective wafer mount 504. The stepper motors 306 operate the lead screws 304 to raise or lower respective support points of the jig deck 300 relative to the base 302 and therefore platen 600, and also may be operated to keep the plane of the jig deck 300 parallel to that of the platen 600 and its upper surface 602. Once the wafers (not shown) are in contact with the platen upper surface or polishing pad 602, the amount of weight bearing down on the wafers may be adjusted by actuating the linear actuators 512.

Figure 5:
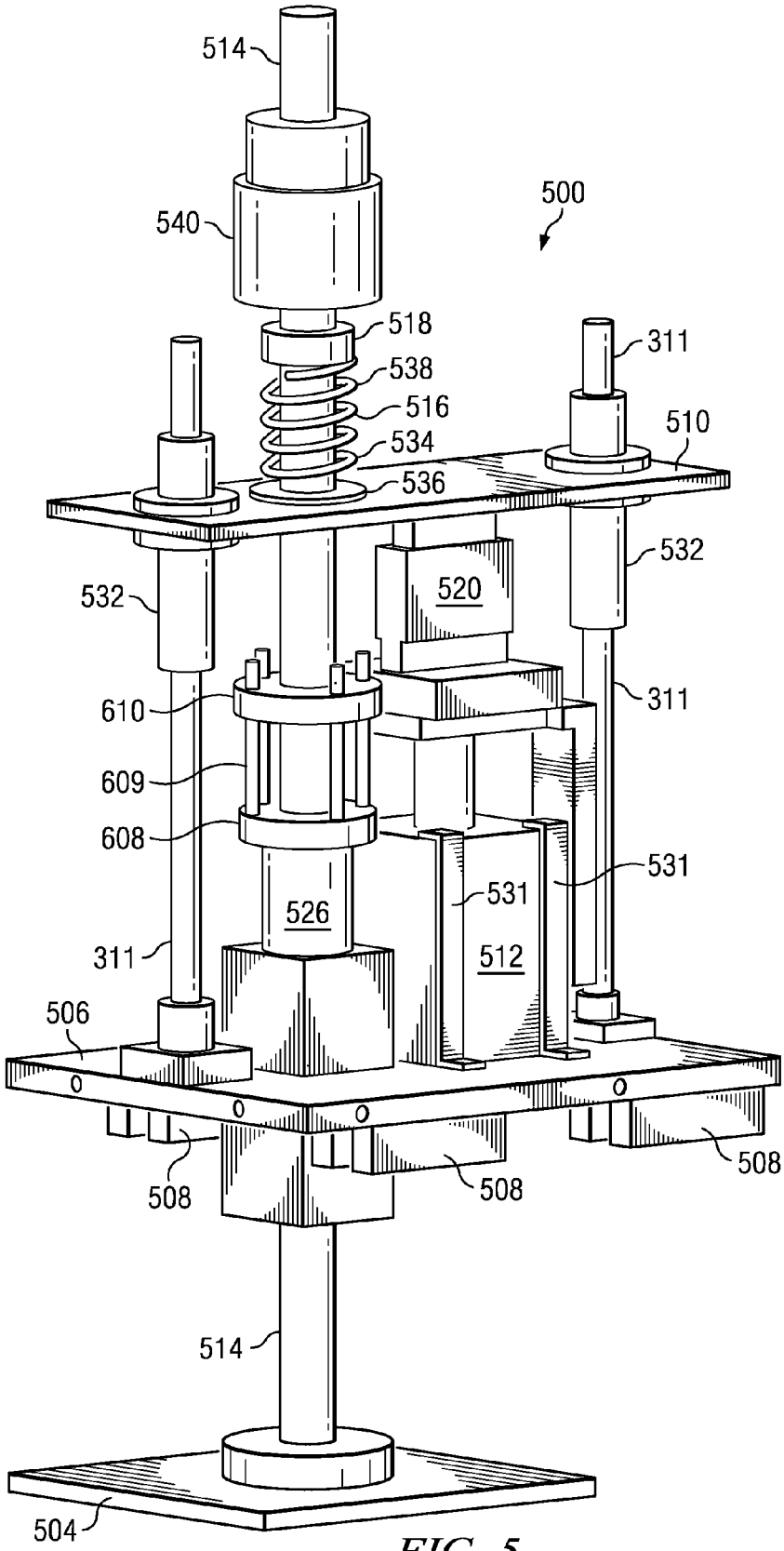
FIG. 5 is a first isometric view of a polishing jig according to the invention, with certain parts omitted for clarity.
Figure 6:
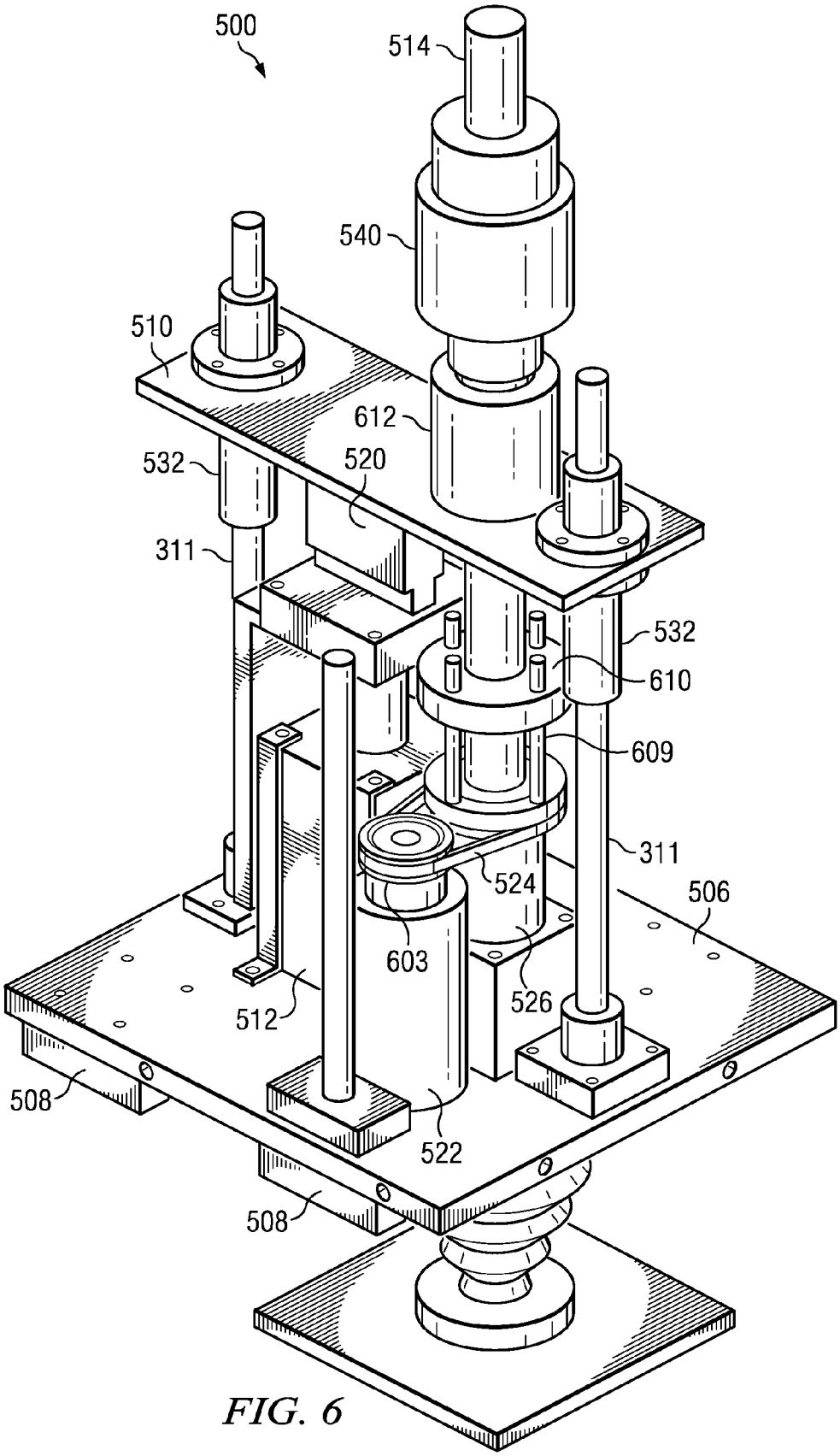
FIG. 6 is an isometric view of the polishing jig shown in FIG. 5, taken from another viewpoint and with certain parts omitted for clarity.

For each jig shaft 514 there is provided at least two upstanding linear alignment shafts 311. The linear alignment shafts 311 have their lower ends affixed to the respective jig plates 506 (FIGS. 2, 5 and 6). The linear alignment shafts are positioned to each side of the jig shaft 514, and are meant to resist any shear or torsional loading on the pressure distribution plate 510.

Figure 4:
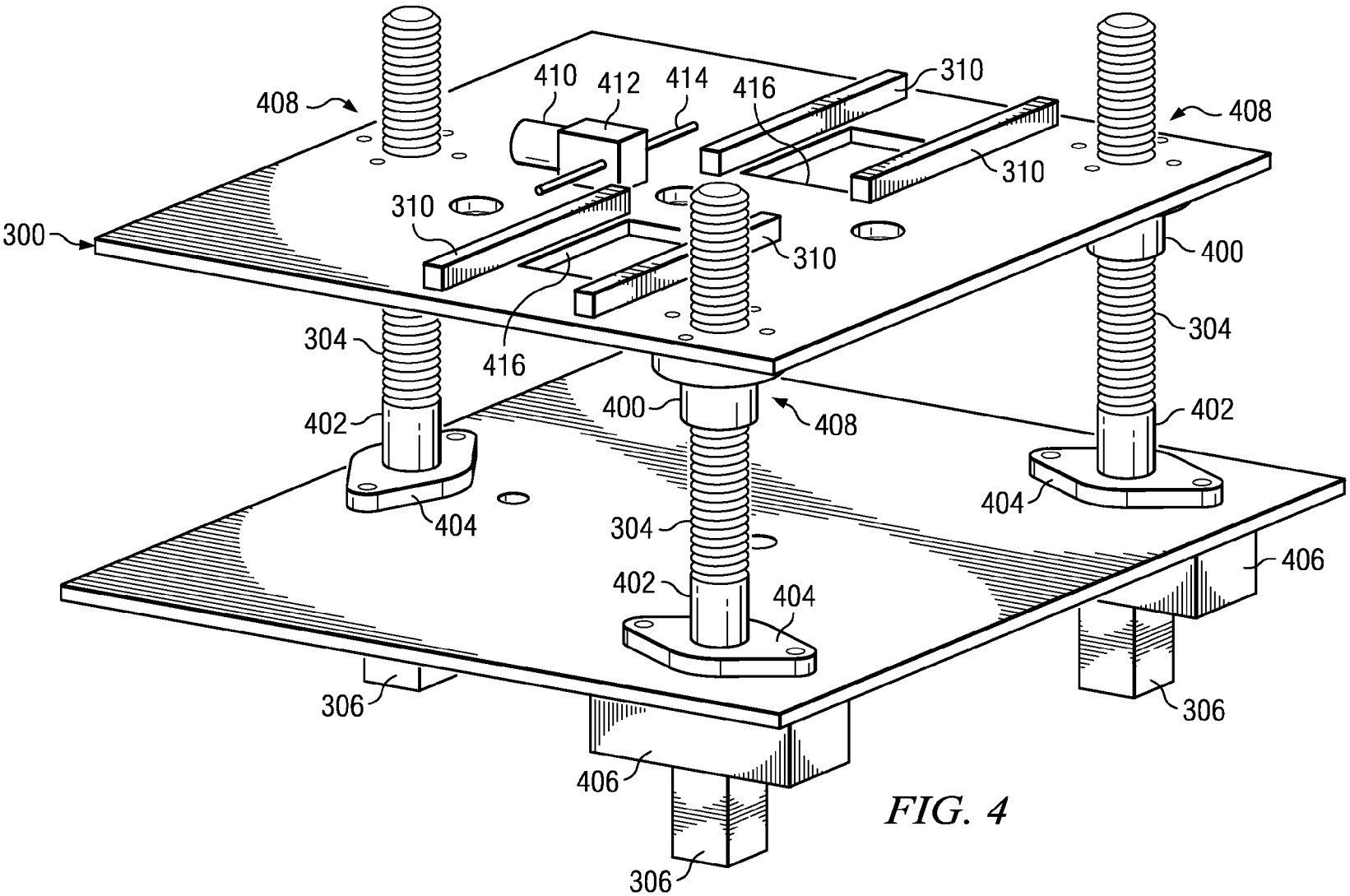
FIG. 4 is an isometric view of the jig deck and base plate of the embodiment diagrammed in FIG. 2.

The jig deck 300 and supporting structures are shown in more detail in FIG. 4. Each lead screw 304 is threaded into a respective mounting flange 400 that itself is affixed to the underside of the jig deck 300. In the illustrated embodiment only a top portion of the lead screws or shafts 304 are threaded; the bottom portions 402 are smooth and are received through ball bearing fittings 404 to be seated in respective tapered roller bearings 406. The screws 304/shafts 402 are turned by the stepper motors 306 so as to selectively raise or lower each of three support points 408 on the jig deck 300, thereby permitting the adjustment of the plane of the jig deck 300 until it is parallel with the platen upper surface 602 (see FIGS. 3, 5 and 6). While the illustrated lead screws 304 are a preferred mechanism for raising, lowering and leveling the jig deck 300, other means may be used instead, such as unthreaded shafts which are simply vertically translated by a suitable motor (not shown), and which would be articulably connected to the jig plate 300 at the respective support points 408 to independently move them up and down.

The jig deck 300 has mounted on it a linear motion motor 410 and associated gear box 412. Out of opposite sides of the gear box 412 extend pins or links 414, and each of these is connected to a respective jig plate 506 (see FIGS. 5 and 6). In the illustrated embodiment, two such jigs 500, 502 are mounted to the jig deck 300, and it is preferred that these jigs 500, 502 be laterally moved simultaneously and in the same direction. In embodiments in which more than two jigs 500, 502 are provided, a substitute mechanism should be provided which moves all of the jigs simultaneously but in an offset manner, i.e., as one jig moves toward the center, the opposite jig is moving away from the center. This will provide a more uniform distribution of polishing slurry on the polishing surface 602 and will thus result in greater uniformity when one polished workpiece is compared with another.

Located between each parallel pair of jig plate rails 310 is an aperture 416, through which a respective jig shaft 514 (not shown in this FIGURE) extends. Each aperture 416 is long enough that the received jig shaft 514 can move through its entire translational course as the jig is moved on rails 310.

FIGS. 5 and 6 are isometric details, taken from angularly separated viewpoints, of a representative jig 500. In the illustrated embodiment, a load cell 520 is disposed in a vertical column with the linear actuator 512, in this illustrated case on top of the actuator 512. Alternatively the load cell 520 could be placed beneath the linear actuator 512. Vertical mounting bars 531 are affixed to the jig plate 506 and are used to mount the linear actuator 512 thereto. In the illustrated embodiment the load cell 520 senses the amount of force experienced between the linear actuator 512 and the pressure distribution plate 510, and generates a signal based on the compressive force which is sensed. On either side of the load cell/actuator stack is a linear alignment shaft 311, which is slidably received in a respective linear alignment bearing 532. Each linear alignment bearing 532 is in turn affixed to the pressure distribution plate 510. A principal purpose of shafts 311 and bearings 532 is to prevent any torque or shear from being experienced by the load cell 520; all force experienced by it will be in a completely columnar direction.

The compression spring 516 preferably has a high spring constant, such as one in the range of 15 to 100 lbs./in., and preferably is mounted to be coaxial with the jig shaft 514. A lower end 534 of the spring 516 bears on a thrust bearing 536, itself mounted to the compression plate 510. An upper end 538 of the spring 516 abuts a stop, here taking the form of a shaft clamp 518, that is affixed to the shaft 514. While a helical compression spring 516 is preferred, and more particularly one which expands and contracts along an axis that has a component which is parallel to the axis of shaft 514, alternatively other springs could be used, such as a leaf spring, a wave spring, or other apparatus which causes the displacement of the jig shaft to vary as a function of a spring constant or its equivalent. It should be noted that spring 516 is in general continuously movable or deflectable from a relatively relaxed condition to a relatively stressed or (in the illustrated embodiment) compressed one. A principal utility of the spring 516 is to make the increase or decrease in the amount of force experienced by the platen more gradual as a function of the vertical displacement of shaft 514. An encoder 540 is also mounted coaxially of the central shaft 514 and records the angular displacement of the central shaft 514 about its axis; a signal output by encoder 540 can be used to regulate the rotation of shaft 514, as will be explained below.

As best seen in FIG. 6, the central shaft 514 is rotated by means of a DC motor 522 through the following mechanical linkage. A timing belt pulley 603 is mounted to be coaxial of the axis of the DC motor 522. A toothed timing belt, schematically shown at 524, extends around the pulley 603 and around an external timing belt surface of a rotational and linear bearing 526. The rotational and linear bearing 526 rotates independently of the central shaft 514 via the clutch mechanism made up by components 524, 526, 609 and 610 described above. A rotational and linear bearing clamp 608 is affixed to the exterior of the rotational and linear bearing 526. Four clamp rods 609 extend upward from the bearing clamp 608 in a direction parallel to shaft 514 to provide a retractable mechanism between the bearing clamp 608 and a shaft clamp 610. When the DC motor 522 is powered, linear/rotational bearing 526 rotates, imparting rotation of the bearing 526 to the central shaft 514. Because of a clutch action between the clamp rods 609 and linear bearings (not shown) contained within shaft clamp 610, rotation of the bearing 526 can be selectively imparted to the central shaft 514. In use, the spring 516 (FIG. 5) is enclosed by a spring cage 612.

Figure 7:
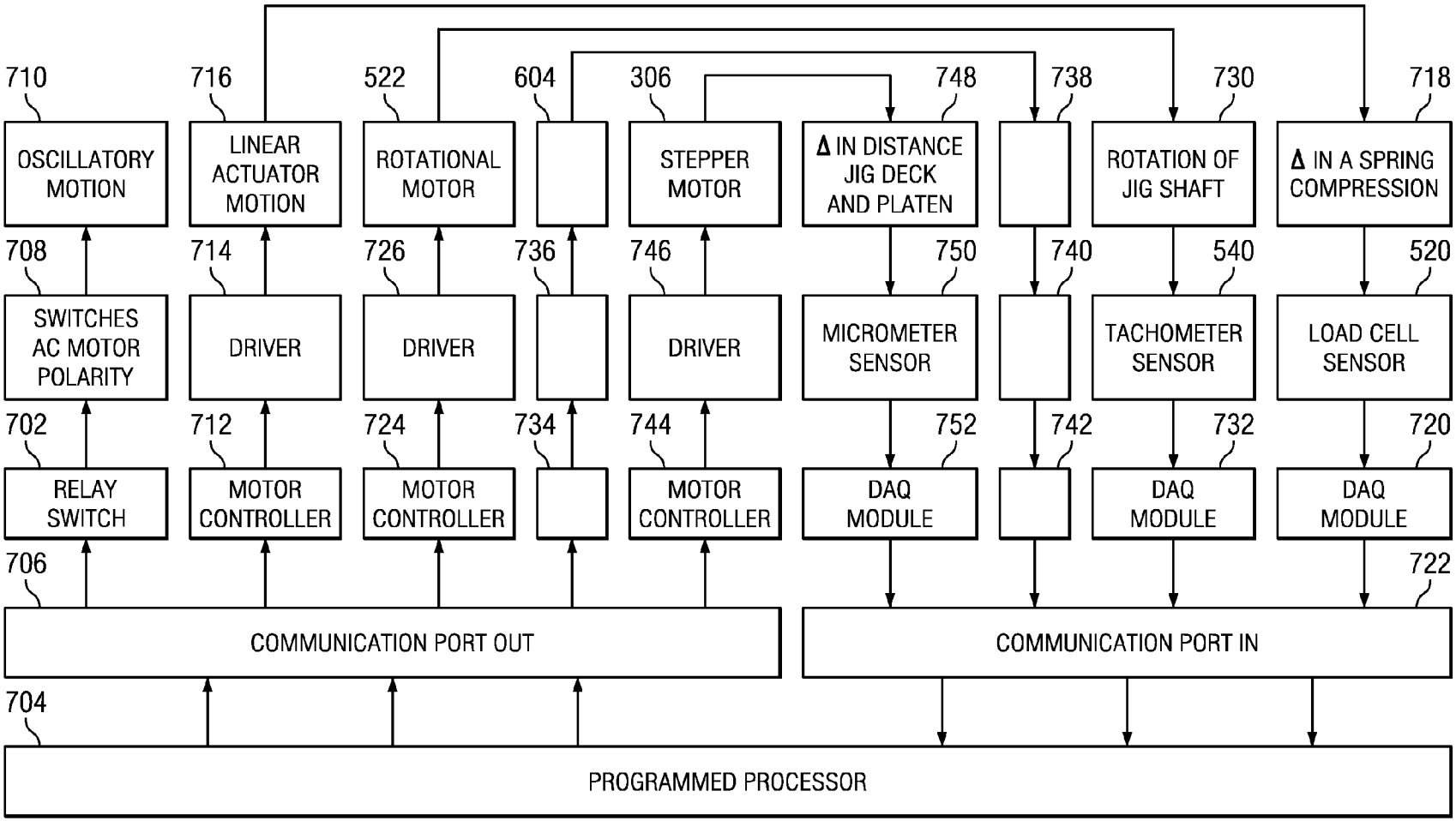
FIG. 7 is a data acquisition (DAQ) and control flow chart showing how the motions of the various components of the polishing machine are sensed and controlled.

FIG. 7 shows the data flows and control loops between the various motors driving the motions of the machine and the sensors sensing the results of this motion. To control the motion of the reciprocal motor 410, a relay switch 702 receives a command from a central computer or processor as programmed by software 704 and issued through an outbound communications port 706. The relay switch 702 switches the polarity of motor 410 at 708 on a periodic basis, thereby creating a linear oscillation at 710.

A motor controller 712 controls a driver 714 based on a command from the controller 704, causing movement of the linear actuator 512 at 716, to either expand (push upward) or contract (lower). This in turn will cause a change in the relative amount of stress or compression in the spring 516 at 718.

A difference in the spring compression at 718 in turn will cause a difference in the amount of weight of the combination of the wafer, the wafer mount 504, the jig shaft 514 and any other component of the jig mounted on shaft 514 (such as central shaft clamp 610) which is experienced by the actuator/load cell column. This difference in compressive force is sensed by the load cell 520, and a signal output by the load cell encoding the value of compressive force is sent to a data acquisition (DAQ) module 720. The signal is provided to an inward bound com port 722 and thence to the programmed processor 704. Thus, there is a feedback mechanism by which the force sensed by the load cell 520 can be used to control the position of the linear actuator 512. The signal received by module 720 can be compared to a stored reference and the linear actuator 512 can be expanded or contracted depending on the amount and direction of difference. This provides a degree of control over polishing pressure which has not heretofore been realizable by conventional polishing apparatus, particularly with the light pressures applied to polish the surface of Group II-VI semiconductor layers.

Other control loops may be employed to control the rotation of certain components about their axes. A motor controller 724 controls a driver 726, which in turn provides current to jig shaft rotational motor 522 (there are actually separate control loops for each shaft 514). Rotation of the shaft 514 caused by motor 522 at 730 is sensed by the jig shaft encoder 540, which in turn provides an angular displacement signal to a DAQ module 732. This loop provides a method of controlling the speed of each shaft 514. Similarly, a motor controller 734 supplies a signal to a driver 736, which in turn supplies current to platen rotational motor 604. The rotation of platen 600 is sensed at 738 by a tachometer sensor 740, which responsive to this transmits an angular displacement signal to a DAQ module 742. This loop provides a method of controlling the speed of the rotation of the platen 600.

Responsive to a command from the programmed processor 704, a motor controller 744 supplies a signal to a driver 746, which in turn supplies current to a respective stepper motor 306. A difference in the position of the jig deck support point relative to the platen 600 is sensed at 748 by a micrometer 750, which in turn supplies a signal back to a DAQ module 752. Two other control loops (not shown) exist for the other stepper motors 306. This provides a method for controllably raising and lowering the jigs relative to the platen surface, and also to assure the parallelism of the jig deck 300 to the platen upper surface 602.

Figure 8:
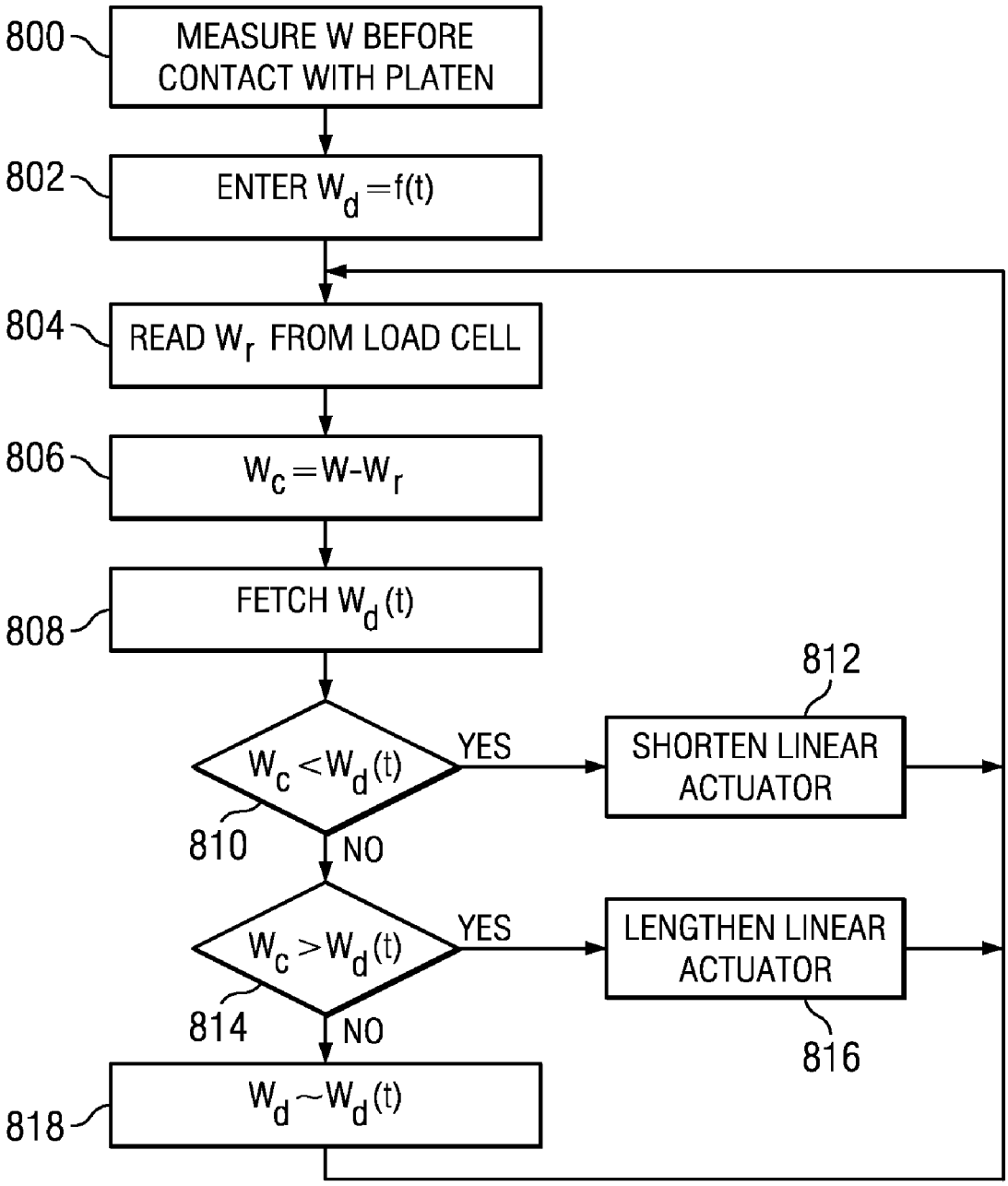
FIG. 8 is a flow chart showing how control logic may be used to regulate the amount of polishing pressure.

FIG. 8 is a logical flow chart showing one possible schema for regulating the force applied by the wafer surfaces to the upper surface 602 of the platen 600. At a step 800, and prior to the contact of the wafers to the platen, the "first weight" W (that is, all of the weight suspended by the central jig shaft 514) is measured by the respective load cell 520. This weight is stored. At step 802, the operator or programmer of the machine, as controlled by programmed processor 704 which has been programmed by a suitable software program, enters a series of desired applied weights $[W_d]$ which may vary as a function of time. These weights may be entered as a linear array, and may be points off of a sinusoid, a square wave, another step function or any other desired wave form.

At step 804, a relieved weight $W_r$, which is a fraction of the weight W as above described, is read from the load cell 520. Next, at step 806 the processor 704 can calculate a current weight $W_c$ by subtracting the sensed $W_r$ from W. At step 808, and for a time t, a member $W_d(t)$ is retrieved from the stored array $[W_d]$. A comparison is done at steps 810 and 814. If the current weight $W_c$ is less than the retrieved desired weight $W_d(t)$, or preferably less than that desired weight less a predetermined deadband or tolerance, then at step 812 the linear actuator 512 will be shortened by an increment. If the current weight $W_c$ is more than the retrieved desired weight $W_d(t)$, or preferably more than that desired weight plus a predetermined deadband or tolerance, then at step 816 the linear actuator 512 will be lengthened. If neither of these conditions obtain at step 818, such that the current weight $W_c$ is within a deadband or desired degree of tolerance from current desired weight $W_d(t)$, then no change is made and the procedure loops back to read the next value of $W_r$. The illustrated control logic is illustrative only and other, possibly more elaborate control logic may be employed by controller 704 instead.

In summary, novel polishing apparatus has been shown and described that is particularly adapted for the polishing of relatively fragile workpieces such as layers of Group II-VI semiconductor material. Various motions of the polishing components are tightly controlled through feedback loops. In particular, the amount of weight applied by the wafers being polished to the surface of a polishing platen can be selected to be considerably less than the weight of the workpieces themselves. A spring is employed such that the amount of relieved weight, and therefore the amount of applied weight, varies smoothly over a relatively large displacement of the wafer-bearing jig shaft, rather than such weight varying abruptly when the wafer is taken up or set down on the platen. A control loop controls this relieved weight such that it is possible to intentionally vary the polishing weight over time according to a predetermined time-varying function.

While certain embodiments of the present invention have been described above and illustrated in the appended drawings, the present invention is not limited thereto but only by the scope and spirit of the appended claims.

We claim:

1. A process for polishing a workpiece, comprising the steps of:

suspending a first weight by a jig shaft above a polishing platen by a weight support, the first weight including the weight of the jig shaft and the weight of the workpiece;

controllably lowering the workpiece and jig shaft toward an upper surface of the polishing platen until the workpiece contacts the platen;

incrementally removing a weight support of the jig shaft and workpiece such that incrementally more of the first weight is borne by the platen;

repeatedly sensing an amount of the first weight which is presently being supported by the weight support; and halting the incremental removal of the weight support once said amount of supported weight approximates a predetermined stored value, such that a known amount of pressure is applied between the workpiece and the platen.

2. The process of claim 1, wherein the step of sensing is performed by a load cell which is a portion of said weight support.

3. The process of claim 1, wherein said step of incrementally removing the weight support of the jig shaft is performed by a linear actuator which is expansible and contractable in a vertical direction, the linear actuator incrementally contracting in order to remove an increment of weight support.

4. The process of claim 1, and further comprising the steps of:

periodically sensing said amount of the first weight supported by the weight support as a polishing operation continues;

responsive to sensing at least a predetermined increase in said amount of the first weight above a predetermined stored value, removing increments of weight support until about the predetermined amount is again sensed; and responsive to sensing at least a predetermined decrease in said amount of the first weight above a stored predetermined value, restoring increments of weight support until about the predetermined value is again sensed.

5. The process of claim 1, and further including the step of:

using control circuitry to control the weight support such that the stored predetermined value varies as a function of time.

6. The process of claim 5, and further including the steps of:

inputting an array of values into an electronic memory, ones of the array having values which are different from others of the array; and periodically retrieving different ones of the array, such that the retrieved predetermined value used for comparison with the first weight varies as a function of time.

7. The process of claim 6, wherein the array of values comprises points from a sinusoid wave form.

8. The process of claim 6, wherein the array of values comprises points from a square wave.

* * * * *